US007335037B2

(12) United States Patent
Razafiarivelo et al.

(10) Patent No.: US 7,335,037 B2
(45) Date of Patent: Feb. 26, 2008

(54) ELECTRICAL CONNECTOR WHICH IS EQUIPPED WITH A RAPID DISCONNECTION SYSTEM

(75) Inventors: Jean Razafiarivelo, La Ferte Bernard (FR); Laurent Morin, Lorient (FR)

(73) Assignee: FCI, Versailles (FR)

( * ) Notice: Subject to any disclaimer, the term of this patent is extended or adjusted under 35 U.S.C. 154(b) by 0 days.

(21) Appl. No.: 10/574,996

(22) PCT Filed: Oct. 7, 2004

(86) PCT No.: PCT/FR2004/050496

§ 371 (c)(1),
(2), (4) Date: Apr. 6, 2006

(87) PCT Pub. No.: WO2005/034298

PCT Pub. Date: Apr. 14, 2005

(65) Prior Publication Data

US 2007/0066108 A1 Mar. 22, 2007

(30) Foreign Application Priority Data

Oct. 7, 2003 (FR) ..... 03 50658

(51) Int. Cl.
*H01R 13/62* (2006.01)

(52) U.S. Cl. ..... 439/157; 439/347

(58) Field of Classification Search ..... 439/157, 439/347

See application file for complete search history.

(56) References Cited

U.S. PATENT DOCUMENTS 4,865,554 A * 9/1989 Matsuoka et al. ..... 439/70
5,120,255 A 6/1992 Kouda et al. ..... 439/489
5,178,552 A * 1/1993 Jinno et al. ..... 439/140
5,183,410 A * 2/1993 Inaba et al. ..... 439/489
5,376,014 A * 12/1994 Sumida ..... 439/310
6,036,509 A * 3/2000 Maejima ..... 439/157
6,036,524 A * 3/2000 Suzuki et al. ..... 439/354
6,045,375 A * 4/2000 Aoki et al. ..... 439/157
6,062,882 A * 5/2000 Hanazaki et al. ..... 439/157
6,142,799 A * 11/2000 Marcel ..... 439/152
6,341,973 B1 * 1/2002 Endo ..... 439/352
6,491,542 B1 12/2002 Zerebilov ..... 439/489
6,497,584 B1 * 12/2002 Murakami et al. ..... 439/352
6,524,125 B2 * 2/2003 Nakamura ..... 439/352

(Continued)

FOREIGN PATENT DOCUMENTS

EP 0 984 524 A2 3/2000

(Continued)

*Primary Examiner*—Tulsidas C. Patel
*Assistant Examiner*—Vladimir Imas
(74) *Attorney, Agent, or Firm*—Harrington & Smith, PC

(57) ABSTRACT

The invention relates to an electrical connector which is equipped with a rapid disconnection system. In order to reduce damage caused to the electrical connector by electric arcs, the inventive connector comprises a release (15) and a spring (16). According to the invention, the release is intended to co-operate with a case (3) in order to authorise the movement of the disconnection device (4), while the spring, which is solidly connected to the case and the disconnection device, enables the rapid disconnection of the case and cover parts (2) forming the connector, thereby producing the rapid disconnection of the contacts (5, 7) which are attached to each of the two parts respectively.

19 Claims, 3 Drawing Sheets

U.S. PATENT DOCUMENTS

Figure 1A:
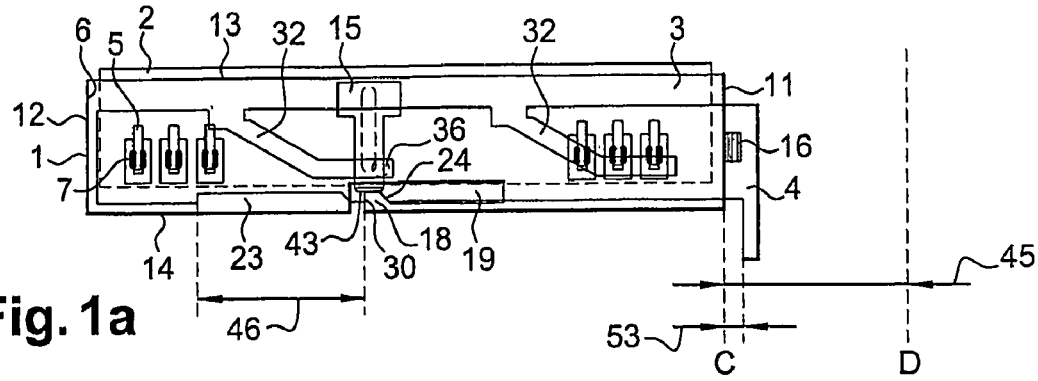

| | | | | |
|---|---|---|---|---|
| 6,641,423 | B1 * | 11/2003 | Giro | 439/347 |
| 2004/0038569 | A1 | 2/2004 | Yamaoka et al. | 439/137 |

FOREIGN PATENT DOCUMENTS

| | | | |
|---|---|---|---|
| EP | 1 077 510 | A2 | 2/2001 |
| EP | 1 172 898 | A2 | 1/2002 |
| EP | 1 221 743 | A2 | 7/2002 |
| FR | 2 850 492 | A1 | 7/2004 |
| GB | 2 381 392 | A | 4/2003 |
| JP | 04-209478 | | 7/1992 |
| WO | WO 2004/015820 | A1 | 2/2004 |

* cited by examiner

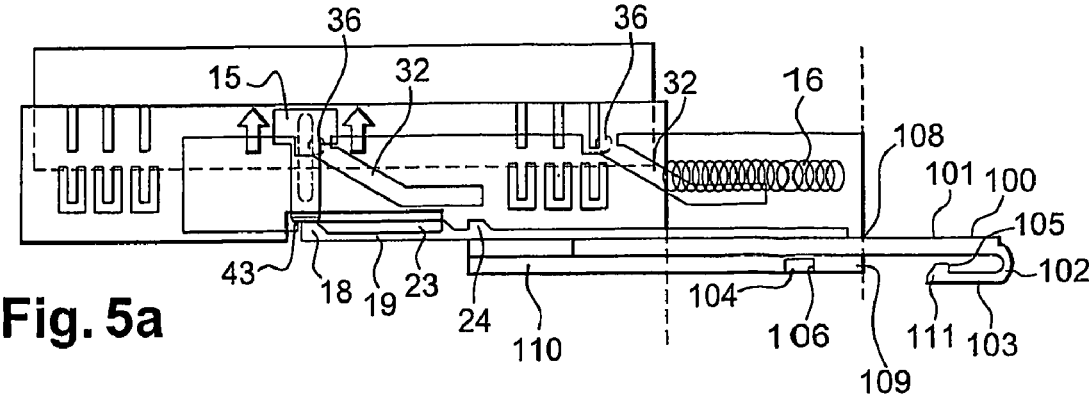
Fig. 5a
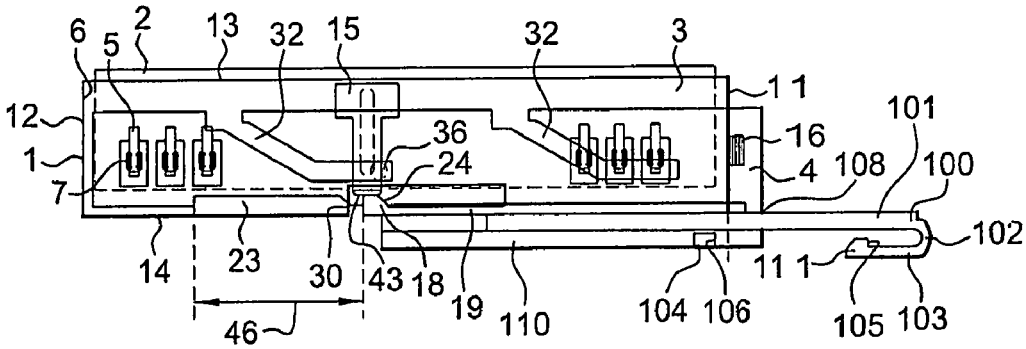
Fig. 5b
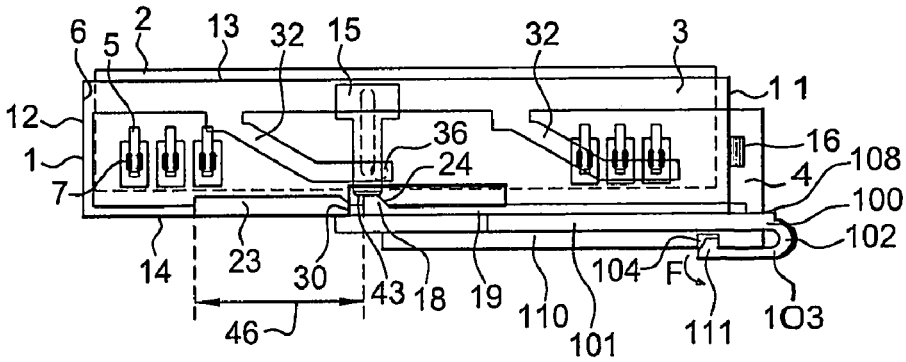
Fig. 5c
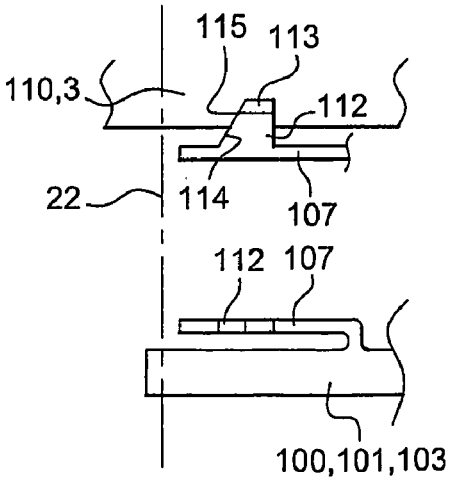
Fig. 6b
Fig. 6a

ELECTRICAL CONNECTOR WHICH IS EQUIPPED WITH A RAPID DISCONNECTION SYSTEM

The invention relates to an electrical connector equipped with a rapid disconnection system. The purpose of the invention is to reduce damage to an electrical connector. In one example, the damage may be premature wear of at least one electrical contact contained in said electrical connector. The damage may be due mainly to phenomena associated with electric arcs. An electric arc is the result of an electrical discharge between a first electrical contact and a second electrical contact when they are gradually moved apart from each other, the first contact and the second contact being subject to a difference in voltage potential. The invention applies in general to the field of automotive connections, but it may be applied in other fields.

An electrical connector comprises a first part equipped with at least one first electrical contact and a second part equipped with at least one second electrical contact. The first part cooperates with the second part in such a manner as to create a physical connection of the first contact to the second contact and thus to permit a passage of electrical current through the first contact and the second contact.

The appearance of electric arcs between the first contact and the second contact poses a problem. It is responsible for premature wear of or damage to the first contact and the second contact. This appearance of electric arcs may lead to an alteration in the transmission function of the connector, for power or data.

Parallel to the problem of damage due to arcing, there is posed the problem of the partial connection or disconnection between the first and the second part of the connector. This problem is manifested by a partial connection or disconnection of at least one contact of the first part of the connector with or from one contact of the second part of the connector. Known in prior art are specific connection and disconnection devices that are used for preventing this type of partial connection or disconnection. These devices include TPA (terminal positioning assurance) devices, CPA (connector positioning assurance) devices, and Go-noGo devices. These disconnection devices cooperate with the first part and with the second part and afford in principle two states: a connected state and a disconnected state.

The connected state corresponds to a state in which the device cooperates with the first part and with the second part in such a manner that it brings about a physical connection between the first contact and the second contact. The connected state of the device prevents the absence of an electrical connection between one or more contacts. The disconnected state corresponds to a state in which the device cooperates with the first part and with the second part in such a manner that it brings about a physical separation of the first contact from the second contact. The disconnected state of the device prevents the maintenance of an electrical connection between one or more contacts.

The transition from a connected state to a disconnected state of the device is accomplished by a manual action on the disconnection device that is intended to separate the first part of the connector from the second part thereof.

The invention described here uses such a device. In the device used, the transition from the connected state to the disconnected state is produced by a separating movement of the device along an axis perpendicular to an axis of connection, the axis of connection being an axis along which the first contact is linked to the second contact. This separating movement results in a separation of the first part in relation to the second part in such a manner that the first contacts separate themselves from the corresponding second contacts.

However, when it is produced manually, the separation of the first part in relation to the second part may not be sufficiently rapid and electric arcs may persist during this time between the first contact and the second contact. Damage to the first contact and to the second contact may thus be produced.

In order to solve this problem, the invention provides for the realization of an electrical connector in which the first part of the connector is separated from the second part in a rapid manner, which results in a equally rapid separation of the contacts united with each corresponding part of the connector. To do this, the invention provides for the association of the connection device with a first means of locking, at least one release, and one guide member or elastic member.

Specifically, in the connected state, the guide member constitutes a spring. This spring is compressed between the second part of the connector and the connection device. When the release is actuated, it frees the connection device from the connected state by acting on the first means of locking. The spring can then extend and separate the disconnection device, causing it to go from the connected state to the disconnected state.

The addition of a release and of a spring, which cooperate jointly, thus makes it possible to assure a rapid disconnection and a predetermined separation of the first contact from the second contact.

Such a rapidly disconnecting connector may present a significant risk of untimely disconnection due, for example, to vibrations or to a shock, such as occurs frequently when the device is mounted in a vehicle, or to an unintended action on the release, such as is produced when the device is located in a complex or difficultly accessible environment. It is thus useful to provide for a device that prevents such a disconnection, including a device that requires the operator to undertake several actions in order to release the disconnection. This is why the invention also provides for a secondary means of locking of the first means of locking. This secondary means of locking is capable, depending on its positioning with respect to the first means of locking, of blocking the movement of the first means of locking controlled by the release.

The subject of the invention is thus an electrical connector comprising

- a cover equipped with at least one first electrical contact,
- a case equipped with at least one second electrical contact, and
- a disconnection device that cooperates with the cover and with the case in order to establish an electrical connection between the first contact and the second contact, which defines a connected state, and in order to bring about a disconnection between the first and the second contact, which defines a disconnected state, characterized in that the electrical connector also comprises
- a first means of locking that makes it possible to maintain the disconnection device in the connected state,
- a release that acts on the first means of locking in order to permit the movement of the disconnection device from a connected state toward a disconnected state of the first and second contact, and
- an elastic member placed between the case and the cover, said member being capable of being moved between a first deformed position in the connected state and a second relaxed position in the disconnected state, said elastic member bringing about a separation of the case with respect to the cover, while electrically disconnecting the first contacts from the second contacts during a change of position of the elastic member from the deformed position toward the relaxed position when the movement of the disconnection device is triggered by the release.

The subject of the invention is also a process for electrical connection of an electrical connector comprising a cover equipped with at least one first electrical contact, a case equipped with at least one second electrical contact, and a disconnection device that cooperates with the cover and with the case in order to establish an electrical connection between the first contact and the second contact, which defines a connected state, and in order to bring about a disconnection between the first and the second contact, which defines a disconnected state, characterized in that it includes the following step the disconnection device is inserted into the case from a front face in the direction of a back face of the case until the device slides along a first means of locking from a first groove to a second groove, the first groove and the second groove being recessed in the disconnection device.

Finally, the subject of the invention is a process for electrical disconnection of an electrical connector comprising a cover equipped with at least one first electrical contact, a case equipped with at least one second electrical contact, and a disconnection device that cooperates with the cover and with the case in order to establish an electrical connection between the first contact and the second contact, which defines a connected state, and in order to bring about a disconnection between the first and the second contact, which defines a disconnected state, characterized in that it includes the following step a release is moved in order to dislodge a first means of locking from a groove recessed in the disconnection device by at least a height corresponding to the depth of said groove.

Figure 1B:
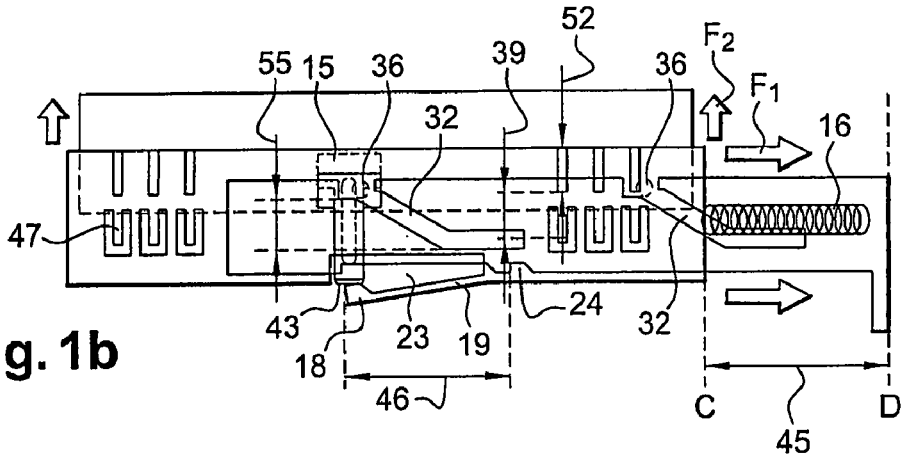
Figure 1C:
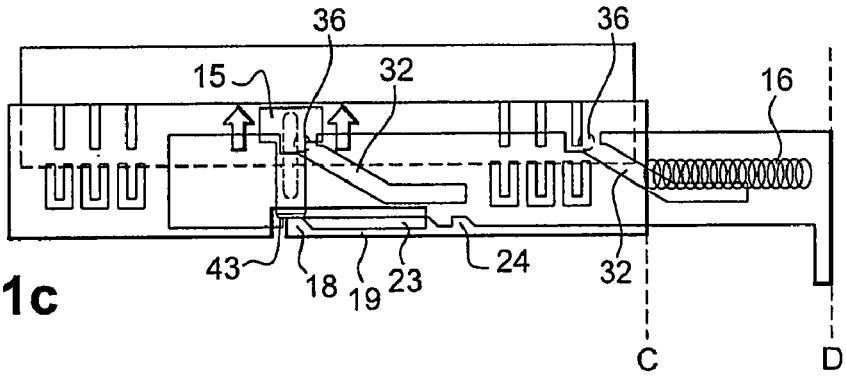
Figure 2A:
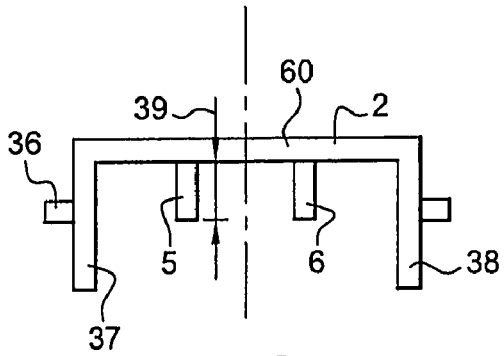

The invention will be better understood by reading the description that follows and by examining the accompanying figures. The latter are presented only by way of example and in no way limit the invention. The figures show:

FIGS. 1*a* to 1*c*: Schematic depictions of an electrical connector in accordance with the invention, FIGS. 2*a* and 2*b*: Schematic depictions of a cover in accordance with the invention, FIGS. 3*a* and 3*b*: Schematic depictions of a case in accordance with the invention, and FIG. 4: A schematic depiction of a disconnection device in accordance with the invention;

FIGS. 5*a* to 5*c*: Schematic depictions of an electrical connector in accordance with a variant of the invention, and FIGS. 6*a* and 6*b*: Schematic depictions of a detent means of the electrical connector in accordance with a variant of the invention.

FIGS. 1*a* to 1*c* illustrate an electrical connector 1, comprising a cover 2, a case 3, and a disconnection device 4 in accordance with the invention. The assembly formed by the cover 2, the case 3, and the device 4 can have the overall shape of a parallelepiped.

In association with the description of the connector 1, 22 designates an axis of connection that defines the axis along which electrical contacts mutually insert. Likewise, 40 designates an axis of connection that is perpendicular to the axis of connection 22 and along which the movement of the disconnection device 4 takes place, FIG. 3*a*.

The cover 2 comprises at least one first electrical contact 5. In one example, the cover 2 can comprise at least six first electrical contacts such as 5, FIG. 1*a*. These first electrical contacts can also be disposed parallel along a first row and a second row and orthogonally with respect to the axis of connection 22. These first contacts, thus disposed, define the first first contacts, such as 5, and the second first contacts, such as 6, FIG. 2*a*.

Figure 2B:
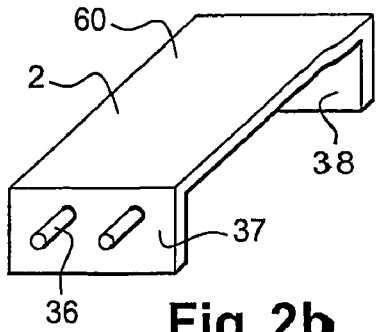

The cover 2 can form a first outer edge 37 and a second outer edge 38, linked perpendicularly to each other by a central plate 60, FIG. 2*b*. On the first edge 37 and on the second edge 38, the cover 2 contains at least one catch 36, which extends laterally with respect to a plane formed by the first outer edge 37 and by the second outer edge 38, FIGS. 2*a*, 2*b*. In one example, the cover 2 contains four catches, such as 36. More specifically, the first edge 37 and the second edge 38 can each contain two catches, such as 36.

The case 3 cooperates with the cover 2 longitudinally with respect to the axis of connection 22 in such a manner that an electrical contact can be established between each of the first contacts 5 and each of the corresponding second contacts 7.

Figure 3A:
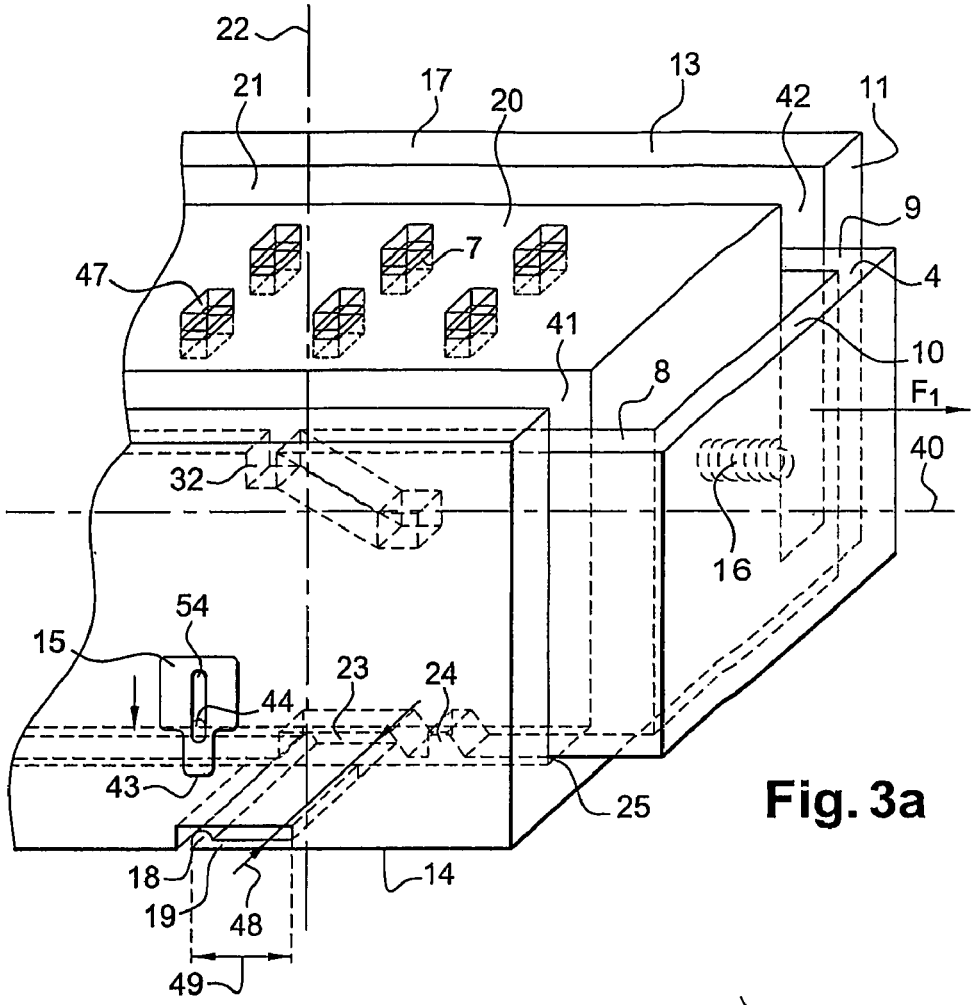
Figure 3B:
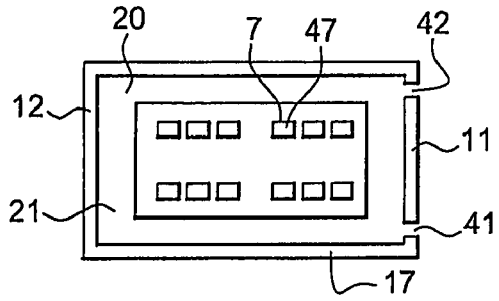

FIG. 3*a* illustrates a partial three-dimensional depiction of a case 3 and FIG. 3*b* illustrates a plan view of the case 3. In one example, the case 3 contains as many second contacts 7 as first contacts 5, associated with the cover 2.

The case 3 comprises a front face 11 and a back face 12, the front face 11 lying opposite the back face 12. The case 3 can also comprise a top face 13 and a bottom face 14, the top face 13 being a face by means of which the cover 2 is inserted. The front and back faces are situated in the planes perpendicularly to the top and bottom faces, FIG. 3*a*.

The faces 11, 12, 13, 14 and the inner and outer bottoms 25 and 14 of the case 3 define a peripheral wall 17, which delimits with a central block 20 a peripheral chamber 21. This peripheral chamber 21 opens at a first point and at a second point of the front face 11 of the case 3 by way of a first slit 41 and by way of a second slit 42, respectively, FIGS. 3*a* and 3*b*.

The connector comprises a first means of locking 19, which makes it possible to maintain the disconnection device 4 in a connected state. In fact, the first means of locking can be formed by a flexible tongue 19. More specifically, this tongue 19 is formed starting at the bottom 14 of the case 3 in the peripheral wall 17. It is cut out in a thickness of the case at a point starting from the inner face 14. The tongue 19 is elastic and can extend over a width 48 measured along an axis orthogonal to the axis of connection 40 from the peripheral wall 17 up to the peripheral chamber 21 of the case 3 at a point of the bottom face 14 of the case 3. This tongue 19 can also extend over a length 49 measured along an axis parallel to the axis of connection 40 going from the front face 11 in the direction of the back face 12 of the case 3. The tongue 19 contains an end 18, FIG. 3*a*. This end 18 mates a shape of at least one groove 24 that is cut out in the device 4 and will be described in greater detail below, FIG. 4.

The peripheral chamber 21 is the place of insertion of the cover 2 in the case 3, said cover 2 being inserted by way of its outer edges 37 and 38.

The disconnection device 4 cooperates with the cover 2 and the case 3 in such a manner that an electrical connection is made between the first contacts 5 and the corresponding second contacts 7.

Figure 4:
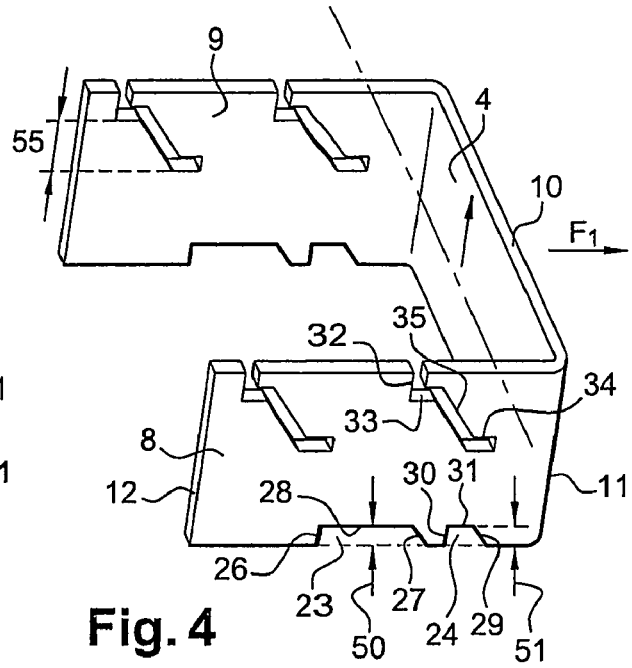

The disconnection device 4 can have a rectangular U shape, FIG. 4. The disconnection device 4 comprises a first arm 8 and a second arm 9, the first arm 8 being linked to the second arm 9 by way of an intermediate portion 10. The first arm 8 and the second arm 9 are inserted by way of the front face 11 of the case 3.

The disconnection device 4 is inserted into the case 3 by way of the first slit 41 and by way of the second slit 42. The disconnection device 4 is inserted into the case 3 by sliding into the chamber 21 longitudinally with respect to the axis of connection 40. The device inserts between the outer edges 37 and 38 of the cover 2 and the peripheral wall 17 of the case 3 by means of the first arm and the second arm.

The disconnection device 4 also comprises at least one slot 32 recessed on the two arms 8 and 9 at a site of the device 4 corresponding to the top face 13 of the case 3, near to the top face 13 of the case 3. This slot 32 forms a first section 33 and a second section 34, linked transversally to each other by a transverse section 35, FIG. 4. The first section 33 and the second section 34 are disposed on mutually parallel planes. In the example of FIG. 4, the disconnection device 4 contains four slots, such as 32. The slot 32 is intended to receive the catch 36 formed by the cover 2.

The disconnection device 4 is also recessed on at least one of the two arms 8 or 9 by at least one first groove 23 and at least one second groove 24, at a site intended to face a bottom 25 of the case 3, going from the back face 12 in the direction of the front face 11 of the case 3. The first groove 23 is recessed longitudinally with respect to the axis of disconnection 40 over a greater distance than the second groove 24, FIG. 4. The first groove 23 comprises, going from the back face 12 in the direction of the front face 11, a first right-angled edge 26 and a first beveled edge 27, the first right-angled edge 26 and the first beveled edge 27 being linked by a first bottom 28 of the first groove 23, FIG. 4. The first bottom 28 delimits a first depth 50 measured along an axis parallel to the axis of connection 22. In the same manner, going from the back face 12 in the direction of the front face 11, the second groove 24 comprises a second right-angled edge 30 and a second beveled edge 29, linked to each other by a second bottom 31 of the second groove 24. The second bottom 31 delimits a second depth 51 measured along an axis parallel to the axis of connection 22. The first depth 50 and the second depth 51 are identical, but they may be different, FIG. 4. The disconnection device 4 slides into the case 3 in such a manner that the flexible tongue 19 lodges in the first groove 23 or in the second groove 24 of said disconnection device 4.

In accordance with the invention, the electrical connector 1 comprises a release 15 and a guide member 16 or elastic member 16, FIGS. 1*a* to 1*c* and 3*a*. In a preferred example, the guide member can be an elastic guide member and can form a spring 16. This spring can be a compression spring, as depicted in FIGS. 1*a* to 1*c*. Or else this spring can be an extension spring (not depicted).

The release 15 cooperates with the case 3 so as to permit the movement of the disconnection device 4. The release 15 is situated on the peripheral wall 17, delimited by the case 3, FIGS. 3*a* and 3*b*. The release 15 is supported on the end 18 of the tongue 19 of the case 3 along the axis of disconnection 40.

The release 15 is supported against the end 18 of the flexible tongue 19 in order to bring about the movement of the flexible tongue 19 of the case 3 longitudinally with respect to the axis of connection 22 from the top face 13 in the direction of the bottom face 14 of the case 3, FIG. 3*a*. The release slides along the axis parallel to the axis of connection 22 by way of a contact piece 44, formed from the peripheral wall 17, inserting into a longitudinal slot 54 recessed in the release 15 facing the peripheral wall 17. The release 15 is supported against the tongue 19 so as to bring about the movement of the tongue by a height measured along the axis parallel to the axis of connection 22 that is sufficient to dislodge the end 18 from the second groove 24, FIG. 1*a*. This height corresponds to at least the second depth 51.

The elastic member is capable of adopting a first deformed position and a second relaxed position, a position of rest or equilibrium. In the case where the elastic member forms a compression spring, the first deformed position corresponds to a state where the spring is compressed with respect to a position of equilibrium rest. In the case where the elastic member is an extension spring, the first deformed position corresponds to a state where the spring is extended with respect to its equilibrium position.

The spring 16, such as depicted in FIGS. 1*a* to 1*c*, is situated between the case and the cover. The spring can be supported directly against the case and against the cover. In a preferred example, the spring is disposed indirectly between the case 3 and the cover by supporting each of the ends of the spring against the case on the one hand and against the device on the other hand. But the spring may be placed indirectly between the case and the cover by supporting each of the ends of the spring against the cover 2 on the one hand and against the device on the other hand.

More specifically, the spring 16 is situated longitudinally along the axis of disconnection 40 between the front face 11 of the case 3 and the intermediate portion 10 of the disconnection device 4. The spring 16 is linked longitudinally along the axis of disconnection 40 to the front face 11 of the case 3 and to the intermediate portion 10 of the disconnection device 4. The spring 16 is compressed between the case 3 and the disconnection device 4 in a connected state and extended or relaxed in a disconnected state.

The spring 16 is in a relaxed position, a position of rest or expansion or extension, between the front face 11 of the case 3 and the intermediate portion 10 of the disconnection device 4, FIG. 1*a*, along a length 45 corresponding to at least a length 52 of the first contact 5 and to a length necessary for separating the first contact from the second contact, FIG. 1*b*.

In the case of the extended spring, the spring can be linked to the case 3 and to the device 4 while being held between the case 3 and the disconnection device 4 in the connected state and being relaxed in the disconnected state. It is thus necessary to provide for an inclination of the transversal section 35 that is going from the top face of the case in the direction of the bottom face of the case with the first section and the second section situated from the right to the left of the drawing in FIG. 1*a*, in contrast to what is depicted in the embodiment of the invention having the compression spring. The intermediate part of the device would also be extended along the axis of insertion of the device in order to increase the space between the intermediate part of the device and the case and to receive freely the spring of extension type in equilibrium position.

The process for electrical connection of the electrical connector is realized in the following manner, FIG. 3*a*. The disconnection device 4 is pushed along the axis of disconnection 40 by sliding longitudinally the first arm 8 and the second arm 9 into the interior of the peripheral chamber 21, going from the front face 11 in the direction of the back face 12. The spring 16 is compressed between the device 4 and the case 3 until a length 53.

The disconnection device 4 slides from the front face 11 in the direction of the back face 12 along the axis 40 on the end 18 of the tongue 19 along the first bottom 28 of the first groove 23, then along the first bevel 27 in such a manner that the tongue 19 inserts into the second groove 24. The disconnection device is then fixed in place in the second groove 24 owing to the complementarity of the shape of the end 18 of the tongue and that of the second groove 24.

The disconnection device 4 is inserted into the case in such a manner that the end 18 of the tongue 19 is supported against the second right-angled edge 30 along an axis parallel to the axis of disconnection 40. When the device 4 is thus blocked by insertion of the tongue into the second groove 24, the disconnection device 4 is blocked in a state of connection or in a connected state as mentioned above.

In the course of the longitudinal movement of the device 4 along the axis 40, FIG. 3*a*, the cover 2 is inserted into the peripheral chamber 21 by a movement parallel to the axis of connection 22 of said cover 2, going from the top face 13 in the direction of the bottom face 14 of the case 3. The movement of the cover 2 is due to the sliding of the catches 36, present on the edges 37 and 38 of the cover 2, along the slots 32, FIG. 4. An inclination of the transversal section 35 with respect to the plane formed by the bottom face of the case makes it possible to transform a horizontal movement of the device 4 to a vertical movement of the cover 2. Each of the catches 36 slides along the slots 32 from the first section up to the second section in such a manner that the length of the spring, in the course of this sliding, is gradually diminished in a linear fashion. There does not exist a part of the slot that would correspond to a state of the spring for which the length would be smaller than the length of the spring in the connected state.

The cover 2 is then inserted into the peripheral chamber 21 in such a manner that the first contact 5 links to the second contact by being inserting into a cavity 47 formed by the case and containing the second contact 7. The cover 2 inserts into the chamber 21 in such a manner that each of the catches, such as 36, present on the edges 37 and 38, slide into the corresponding slot 32, from the first section 33 up to the second section 34, passing by way of the transversal section 35. The sliding of the catches into the corresponding slots makes it possible to bring about the movement of the cover to the interior of the case so as to attain the connected state defined further above.

In FIG. 1*a*, the cover 2 is pushed in in such a manner that the first electrical contact 5 inserts into the cavity 47 provided for this purpose. The first contact inserts into the cavity 47 by a height 39 corresponding to a length 52 of the first electrical contact 5 measured longitudinally with respect of the axis of connection 22. The height 39 also corresponds to a distance 55 separating the plane containing the first section 33 from the plane containing the second section 34, FIG. 1*a*. This height 39 also corresponds to a distance 46 separating a point where the tongue 19 is placed, depending on a position of electrical disconnection, in the first groove 23 from another point where the tongue 19 is placed, depending on a position of electrical connection, in the second groove 24. At the end, the height 39 corresponds at least to a distance that permits an electrical contact between the first contact and the second contact.

The process for electrical disconnection of the electrical connector is realized in the following manner, FIGS. 1*a* to 1*c*. The release 15 is caused to slide in a longitudinal direction to the axis of connection 22, going from the top face 13 in the direction of the bottom face 14. This release 15 is caused to slide in such a manner that one end 43 of said release 15 is supported against the end 18 of the tongue 19 and brings about a movement of the tongue 19, which is made possible by the flexible character of the tongue. The movement of the tongue occurs from the top face 13 in the direction of the bottom face 14. The release 15 brings about a movement of the tongue 19 by a height necessary for dislodging the end 18 of the tongue 19 from the second groove 24. For example, in FIG. 4, if the tongue 19 is placed with its end 18 supported against the second bottom 31, the release must then be moved by a height corresponding at least to the second depth 51 of the second groove 24. The release 15 thus permits the movement of the disconnection device 4 at the moment when the tongue 19 is dislodged from the second groove 24, FIG. 1*b*. The spring 15, compressed between the case 3 and the device 4, can then extend by a length 45.

The spring 16 brings about at least an ejection of the device 4 longitudinally with respect to the axis of connection 40 by a length 45, corresponding at least to the length 52 of the first contact 5. This ejection of the disconnection device permits an ejection of the cover of the case. The ejection of the device 4 is depicted by an arrow F1 in FIGS. 1*b*, 3*a*, and 4. The ejection of the cover 2 is depicted by an arrow F2 in FIG. 1*b*.

The choice of the stiffness constant of the spring makes it possible to control the speed of movement of the spring and, as a result, to impart to the disconnection system a high speed of movement. There ensues a rapid disinsertion of the cover 2 from the case 3, which brings about the rapid disinsertion of the first united contacts of the cover 2 from the second united contacts of the case 3.

The electrical connector in accordance with the invention may be equipped with TPA, CPA, or Go-noGo systems.

The cover 2 may be replaced by the case 3 and vice versa.

In another embodiment example, the invention may also function for connectors such as those described in the documents EP 1,077,512 A2, EP 1,005,112 A2 and EP 1,296,416 A1. In fact, in these documents, it is described that the electrical connection is brought about, respectively, by a lever and a pinion, by a lever and a cam, or by combination of a lever and a caliper. In these cases, the lever plays the role of the disconnection device such as described in the invention, to which it is necessary to add the elastic element and the release.

In another embodiment example of the invention, in FIGS. 5*a* to 5*c*, it can be provided for that the connector comprises a second means of locking 100 or secondary lock 100. This lock 100 is capable of being moved between a first position, referred to as open, and a second position, referred to as closed. This lock is capable of being moved between a position blocking the tongue 19 and a position freeing the tongue, the lock being manipulated from the blocking position to the freeing position so that the tongue can be actuated by the release.

In this other embodiment example of the invention, this lock 100 cooperates with the disconnection device 4. In fact, the intermediate portion 10 of the disconnection device can be extended perpendicularly, then parallel, in the sense of insertion of the device 4, into the case, while, at the same time, turning the case 3 and being positioned facing the bottom of the case. This disconnection device is then extended, thereby forming an extension arm 109. This extension arm 109 forms a support wall 110 at a point of the arm situated facing the bottom of the case. This wall 110 forms a plane parallel to the plane formed by the bottom of the case. The wall 110 may be U-shaped or else the wall may form a plate. This wall 110 is created in such a manner that it is situated at least facing the tongue. The extension arm 109 is also recessed by a guide slit 108 so as to permit the lock to insert between the bottom of the case and the support wall 110. The arm 109 may be formed equally by the case, the cover, or the device 4.

In the closed position of FIG. 5*c*, the lock 100 inserts between the bottom of the case and the support wall 110 of the arm. More specifically, the lock 100 inserts between the tongue 19 and the wall 110. In the closed position of the lock 100, it is impossible to free the tongue from the second groove 24.

The lock 100 comprises a support 101, an elastic arm 102, and a hook 103, the arm linking elastically the support to the hook in such a manner that the support and the hook are situated on the two sides of a plane formed by the support wall 110. In the closed position, the lock 100 is detented to the support wall 110 by insertion of a boss 111 into a notch 104. The boss 111 forms a first detent means of the lock 100. The boss 111 is formed at one end of the hook 103 and the notch 104 is formed by the support wall 110. The notch 104 could also be formed on the case or else on the cover. It would then be necessary to create the lock in such a manner that the boss 111 could be position facing the notch. In order to withdraw the lock 100 and permit the tongue to be freed from the second groove 24, it is necessary to maneuver the hook 103 along the arrow F either by hand or by means of an instrument, FIGS. 5*b* and 5*c*. This maneuvering of the hook 103 is intended to withdraw the boss 111 from the notch 104 so as to move the support 101 with respect to the tongue 19. The support is moved with respect to the tongue in such a manner that the tongue can be moved by the release. In the example of FIG. 5*b*, the support is withdrawn longitudinally with respect to the axis of insertion of the device 4 into the case, in the sense opposite to the sense of insertion of the device into the case.

The boss 111 that is intended to cooperate with the notch 104 forms a first detent means of the lock 100, which prevents the lock 100 from being pulled by accident or inadvertently. Thus, it is possible to provide that the boss comprises a first surface 105 and that the notch comprise a second surface 106. The first surface and the second surface cooperate while, at the same time, abutting each other, the first surface and the second surface being each formed in a plane perpendicular to the direction of movement of the secondary means of locking 100. In one example, the direction of movement of the secondary means of locking is parallel to the axis of insertion of the disconnection device.

In order to disconnect the first contacts from the second contacts, FIG. 5*a*, it is necessary, in the first place, to free the tongue 19 by dislodging the boss 111 from the notch 104, then pulling the lock 100 in the direction opposite to the sense of insertion of the device into the case. It is then possible to actuate the release, which moves the disconnection device 4 in the disconnected position. In order to reconnect the first contacts to the second contacts, it is necessary to push the disconnection device 4 back in until the tongue 19 catches in the second groove 24, without moving the lock 100, and then reclosing the lock 100 until the boss 111 catches in the notch 104. If the lock 100 is not correctly in closed position, it is desirable that it be easily detectable by an element that is easily visible. For example, the lock 100 can comprise a part that becomes projecting with respect to the case when the lock is not correctly positioned with respect to the tongue, that is, when the lock does not prevent the release from causing the movement of the tongue. This projecting part can be made more easily visible by having a particular color.

In the open position of the lock 100, it is advantageous to provide for a second detent means of the lock, which makes it possible to maintain the lock 100 in position with respect to the tongue 19 in such a manner that, when the disconnection device 4 is manipulated toward the connected state, the lock 100 remains in the open position until the device 4 is in the connected position, FIG. 6. The lock 100 remains in the open position, while at the same time being able to leave this position of support by simple pressure on the lock 100 in the direction of insertion of the device into the case. FIGS. 6*a* and 6*b* depict, respectively, a longitudinal section and a transverse section, through this second detent means. This second detent means is formed by an elastic rod 107 and by a protuberance 112 being formed from the rod. This rod is formed in a plane parallel to the support wall and in a plane parallel to the plane formed by the bottom of the case. This rod 107 may be formed starting from the support or starting from the hook. The protuberance 112 extends perpendicularly to the plane of the bottom of the case and is intended to be caught in a notch 113 formed in the case. This notch could also be created in the cover or in the device 4. The protuberance 112 and the notch 113 can comprise, respectively, a third surface 114 and a fourth surface 115, intended to be united together at the moment when it is desired to maintain the lock 100 in an open position. This third surface 114 and this fourth surface 115 each comprise, with respect to the axis of connection 22, an inclined surface in the sense of insertion of the device into the case so as to facilitate the movement of the lock 100 from the supported position of the lock to the blocking position of said lock.

The invention claimed is:

1. An electrical connector comprising a cover equipped with at least one first electrical contact, a case equipped with at least one second electrical contact, and a disconnection device that cooperates with the cover and with the case in order to establish an electrical connection between the first contact and the second contact, which defines a connected state, and in order to bring about a disconnection between the first and the second contact, which defines a disconnected state, characterized in that the electrical connector also comprises a first lock which is adapted to maintain the disconnection device in the connected state, a release which is adapted to act on the first lock in order to permit movement of the disconnection device from the connected state to the disconnected state of the first and second contacts, and an elastic member between the case and the cover, said elastic member being capable of being moved between a first deformed position in the connected state and a second relaxed position in the disconnected state, bringing about a separation of the case with respect to the cover while disconnecting the first contacts from the second contacts when the elastic member changes its position from the deformed position toward the relaxed position, when the movement of the disconnection device is triggered by the release.

2. The connector according to claim 1, further characterized in that the elastic member forms a spring.

3. The connector according to claim 1, further characterized in that the first lock is an elastic tongue formed at a point on the bottom of the case.

4. The connector according to claim 1, further characterized in that the release slides along the peripheral wall of the case and comprises an end intended to be supported against an end of the first lock, the first lock also cooperating with the disconnection device.

5. The connector according to claim 1, further characterized in that the connector is equipped with a Go-NoGo system.

6. The connector according to claim 1, further characterized in that the disconnection device is placed between the case and the cover, the elastic member is linked to the case and to the disconnection device.

7. The connector according to claim 1, further characterized in that the disconnection device comprises a first groove and a second groove, the first lock comprises an end, the device cooperates with the case, while sliding along the first lock, going from the state of disconnection in the direction of the state of connection, in such a manner that the end of the first lock is positioned in the first groove and then in such a manner that the end of the first lock is supported against the second groove.

8. The connector according to claim 7, further characterized in that the first lock is moved by a height necessary for being dislodged from the second groove.

9. The connector according to claim 1, further characterized in that the disconnection device is recessed by a groove comprising a shape that is adapted to the shape of the end of the first lock.

10. The connector according to claim 1, further characterized in that the elastic member extends by a length corresponding to at least the length of the first contact.

11. The connector according to claim 1, further characterized in that it comprises a secondary lock of the first lock that is capable of being moved between a blocking position of the first lock and a freeing position of the first lock, it being necessary to maneuver this secondary lock from the blocking position toward the freeing position so that the first lock can be actuated by the release.

12. The connector according to claim 11, further characterized in that it comprises a support wall, the secondary lock comprising a support, which, in the blocking position of the first lock, inserts between the first lock and the support wall so as to block the movement of the first lock.

13. The connector according to claim 11, further characterized in that the secondary lock comprises a first detent, which opposes the movement of the secondary lock toward the freeing position when the latter is in the blocking position of the first lock.

14. The connector according to claim 13, further characterized in that it comprises a notch and in that the first detent forms a boss that is capable of being inserted elastically into the notch.

15. The connector according to claim 14, further characterized in that the boss and the notch comprise, respectively, a first surface and a second surface, while abutting against each other, the first surface and the second surface being each formed in a plane perpendicular to a direction of movement of the secondary lock.

16. The connector according to claim 11, further characterized in that the secondary lock comprises a support, an elastic arm, and a hook, the arm linking the support to the hook and the hook bearing a first detent, which opposes the movement of the secondary lock.

17. The connector according to claim 11, further characterized in that the secondary lock comprises a second detent that maintains the secondary lock in the position freeing the first lock.

18. A process for the electrical connection of an electrical connection comprising a cover equipped with at least one first electrical contact, a case equipped with at least one second electrical contact, and a disconnection device that cooperates with the cover and with the case in order to establish an electrical connection between the first contact and the second contact, which defines a connected state, and in order to bring about a disconnection between the first and the second contact, which defines a disconnected state, characterized in that it includes the following step the disconnection device is inserted into the case from a front face in the direction of a back face of the case until the device slides along a first lock from a first groove to a second grove, the first groove and the second groove being recessed in the disconnection device.

19. A process for electrical disconnection of an electrical connector comprising a cover equipped with at least one first electrical contact, a case equipped with at least one second electrical contact, and a disconnection device that cooperates with the cover and with the case in order to establish an electrical connection between the first contact and the second contact, which defines a connected state, and in order to bring about a disconnection between the first and the second contact, which defines a disconnected state, characterized in that it includes the following step a release is moved relative to the disconnection device, in order to dislodge from a groove recessed in the disconnection device a first lock, by at least a height corresponding to a depth of said groove.

* * * * *